US006059367A

United States Patent [19]

Rogers

[11] Patent Number: 6,059,367

[45] Date of Patent: May 9, 2000

[54] GLIDING SEATING UNIT WITH EXTENDABLE FOOTREST

[76] Inventor: W. Clark Rogers, P.O. Box 722, 172 Rogers La. Badin Lake, Denton, N.C. 27239

[21] Appl. No.: 09/121,945

[22] Filed: Jul. 24, 1998

[51] Int. Cl.[7] ..... A47C 7/50

[52] U.S. Cl. ..... 297/423.1; 297/88; 297/89; 297/281; 297/DIG. 7

[58] Field of Search ..... 297/68, 88, 89, 297/258.1, 261.1, 273, 281, 423.19, 423.26, 426.28, 423.3, DIG. 7

[56] References Cited

U.S. PATENT DOCUMENTS

| | | | |
|---|---|---|---|
| 3,044,826 | 7/1962 | Schliephacke | 297/88 |
| 3,141,700 | 7/1964 | Fletcher | 297/89 |
| 3,243,227 | 3/1966 | Katz | 297/88 |
| 5,704,686 | 1/1998 | May | 297/281 |
| 5,795,021 | 8/1998 | Rogers | 297/89 X |

*Primary Examiner*—Laurie K. Cranmer
*Attorney, Agent, or Firm*—Myers Bigel Sibley & Sajovec

[57] ABSTRACT

The gliding seating unit comprises: a base configured to rest upon an underlying surface; a seat assembly positioned above the base that includes a generally horizontal seat and a pair of side panels connected with and extending downwardly from opposite side edges of the seat; an extendable ottoman including an ottoman panel; gliding means attached between the base and the seat for enabling and controlling gliding movement of the seat relative to the base; and an ottoman-extending mechanism attached to the seat and the ottoman that includes a seat bracket attached to the seat, an ottoman linkage attached to the ottoman, and an actuation linkage pivotally interconnected with the seat bracket and the ottoman linkage. The ottoman linkage is configured to move the ottoman between a retracted position, in which the ottoman panel is generally upright and located below the seat, and an extended position, in which the ottoman panel is generally horizontally disposed and located forward of the seat. The actuation linkage comprises a rotatable, transversely-extending drive axle that passes through the bracket, a bell crank attached to the drive axle, a spring tab pivotally interconnected with the bell crank, and an ottoman drive link pivotally interconnected with the bell crank and the ottoman linkage. The actuation linkage is configured such that rotation of the drive axle drives the ottoman between its retracted and extended positions.

29 Claims, 7 Drawing Sheets

28
24a
61
22
26
25
54
55
72
52
50a
56
57
58
42
36
20
40
14
16
62
60
80
18
90
14

GLIDING SEATING UNIT WITH EXTENDABLE FOOTREST

FIELD OF THE INVENTION

The present invention relates generally to furniture, and more particularly to seating units having extendable footrests.

BACKGROUND OF THE INVENTION

For many years, rocking chairs have been popular furniture pieces in the home. The repetitive rocking motion of the chair can be quite relaxing and comforting to a seated occupant. In addition, the appearance of the rocking chair is such that it can be used with a variety of furniture styles, particularly traditional styles with a heavy emphasis on visible wood.

In recent years, furniture designers have looked for alternatives to rocking chairs that can provide a similarly relaxing repetitive motion. One alternative has been the gliding chair, or "glider", which includes structure that enables the seat portion of the chair to "glide" forwardly and rearwardly relative to its base to mimic generally the rocking motion of a rocking chair. Often the gliding structure comprises a set of swing links that are pivotally attached at their upper ends to the base and extend downwardly therefrom to attach to a structure, such as a mounting bracket, that is attached to the seat. In this configuration, the seat is suspended from the base and is free to swing forwardly and rearwardly in a double pendulum-type motion in response to a forwardly or rearwardly-directed force applied by a seated occupant. The gliding path of the chair is controlled by the configuration and mounting of the swing links. These chairs can be constructed to resemble traditional rocking chairs and thus are quite popular.

Another type of seating unit that has become popular is the recliner chair. Recliners typically include some type of mechanism that, when actuated, causes the seat and backrest of the recliner to pivot relative to the base in order to place an occupant of the seating unit in a reclined position. Also, many recliners include an extendable footrest, or "ottoman," that extends forwardly of the seat and retracts beneath the seat as desired.

Reclining capability has been combined with gliding capability in a single unit to provide a chair that both reclines and glides. This chair includes a mechanism that enables it to move between upright and reclined positions, and further includes the aforementioned swing links attached between the base and the seat, armrests, or mechanism itself to enable the chair to glide. Examples of such chairs are illustrated and described in U.S. Pat. Nos. 4,536,029 and 4,544,201, both to Rogers, Jr., and in co-pending U.S. patent application Ser. No. 08/957,409, the disclosures of which are hereby incorporated herein by reference in their entireties. In particular, the inclusion of an extendable ottoman can provide a comfortable seating unit.

Despite the advances described above, the gliding chairs with extendable footrests designed heretofore have some significant shortcomings and limitations. One of the more important limitations is the permissible size of the mechanism that extends the ottoman. The ottoman-extending mechanism must fit within the volume bounded by peripheries of the seat and the base, and must be positioned above the underlying surface a sufficient distance that the chair has adequate space to glide. This has been accomplished in large, bulky chairs such as those illustrated in the Rogers patents cited hereinabove, but many prior art mechanisms have been too large to use with a traditionally-sized rocking chair or glider, which typically have a cavity only about 8 to 10 inches in height and 16 to 18 inches in length available for a mechanism. Because of the space limitations, mechanisms that conserve space beneath the chair are desirable.

An additional design consideration for chairs having extendable ottomans is how the ottoman is stabilized in its retracted and extended positions. Commonly, the ottoman is moved from the retracted to the extended position via a handle or other releasing device, then is returned to the retracted position either through the use of the handle or by the occupant exerting a downwardly-directed force with his legs on the extended ottoman. If (as is often preferred) the chair relies on the occupant supplying the force to retract the ottoman, care should be taken in the design of the chair to ensure that the ottoman maintains its extended position and does not retract except when desired.

In addition, some prior chairs with extendable ottomans have suffered from instability problems. Unless some stabilizing mechanism is incorporated into the chair, the seat is free to glide relative to the base irrespective of whether the chair is in the upright position, a reclined position, or an intermediate position between the upright and reclined positions. As such, the occupant typically keeps his feet on the underlying surface for stability when the chair is in the upright position. Of course, when the chair moves from the upright position to one in which the ottoman is extended, the occupant moves his feet out of the way of the extending ottoman. As the occupant moves his feet from the floor, typically the chair reacts with a forward gliding movement. This gliding motion of the chair (along with the posture of the occupant) can give the occupant the feeling that he is being "pitched" forward during extension of the ottoman. Accordingly, it is desirable that a gliding unit having an extendable ottoman be configured to address this problem.

SUMMARY OF THE INVENTION

In view of the foregoing, it is an object of the present invention to provide a glider with an extendable ottoman that is controlled by a mechanism that fits within the typical cavity of space available in a traditionally-styled rocking chair or glider.

It is also an object of the present invention to provide a glider with an extendable ottoman that securely maintains the ottoman in the extended position, but that can be retracted without requiring the use of an actuating handle.

It is an additional object of the present invention to provide a glider with an extendable ottoman that addresses the aforementioned stability problem during extension of the ottoman.

These and other objects are satisfied by the present invention, which is directed to a gliding seating unit that tends to maintain its residence in either the retracted or extended position and can reduce the degree of "pitching" experienced by an occupant as the ottoman is extended. The gliding seating unit of the present invention comprises: a base configured to rest upon an underlying surface; a seat assembly positioned above the base that includes a generally horizontal seat and a pair of side panels connected with and extending downwardly from opposite side edges of the seat; an extendable ottoman including an ottoman panel; gliding means attached between the base and the seat for enabling and controlling gliding movement of the seat relative to the base; and an ottoman-extending mechanism attached to the seat and the ottoman that includes a seat bracket attached to the seat, an ottoman linkage attached to the ottoman, and an actuation linkage pivotally interconnected with the seat bracket and the ottoman linkage. The ottoman linkage is configured to move the ottoman between a retracted position, in which the ottoman panel is generally upright and located below the seat, and an extended position, in which the ottoman panel is generally horizontally disposed and located forward of the seat. The actuation linkage comprises a rotatable, transversely-extending drive axle that passes through the bracket, a bell crank attached to the drive axle, a spring tab pivotally interconnected with the bell crank, and an ottoman drive link pivotally interconnected with the bell crank and the ottoman linkage. The actuation linkage is configured such that rotation of the drive axle drives the ottoman between its retracted and extended positions.

Preferably, the mechanism includes a spring that is attached to the actuation mechanism and is constantly in tension. It is also preferred that the spring bias the bell crank in a first rotative direction when the ottoman is in the retracted position and in a second opposite rotative direction when the ottoman is in the extended position. In this configuration, the seating unit tends to maintain its residency in either the retracted or extended position.

It is also preferred that the mechanism be configured such that the spring begins to bias the bell crank in the second rotative direction after only about 20 to 30 degrees of rotation by the bell crank in the second rotative position. As such, the biasing of the bell crank, and in turn the mechanism, toward the extended position provides a feeling of stability to the occupant to counteract the "pitching" feeling otherwise present in the seating unit during extension of the ottoman.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like components throughout.

This invention is directed to a chair having a stationary base, a seat, and a backrest. As used herein, the terms "forward", "front" and derivatives thereof refer to the direction defined by a vector extending from the backrest toward the seat parallel to the underlying surface. Conversely, the terms "rearward" and derivatives thereof refer to the direction directly opposite the forward direction; i.e., the rearward direction is defined by a vector that extends from the seat toward the backrest parallel to the underlying surface. The terms "lateral", "outward" and derivatives thereof refer to the direction defined by a vector originating in the center of the seat and extending in the plane of the underlying surface and perpendicular to the forward and rearward directions. The terms "inboard", "inward" and derivatives thereof refer to the direction directly opposite to the lateral direction as defined hereinabove.

In addition, mechanisms for moving portions of the seating unit illustrated herein between retracted and extended positions are illustrated as a series of pivotally interconnected links. Those skilled in this art will appreciate that the pivots between links illustrated herein can take a variety of configurations, such as pivot pins, rivets, bolt and nut combinations, and the like, any of which would be suitable for use with the present invention.

Figure 1:
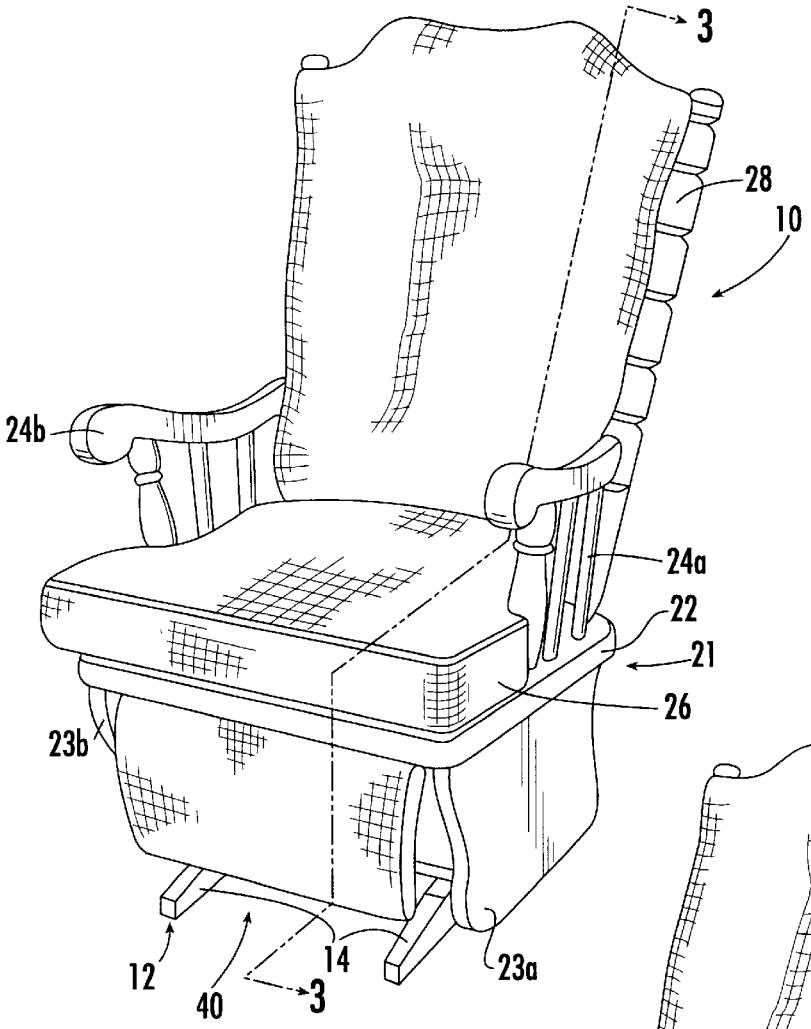
FIG. 1 is a perspective view of the gliding chair of the present invention showed with the ottoman in its retracted position.
Figure 2:
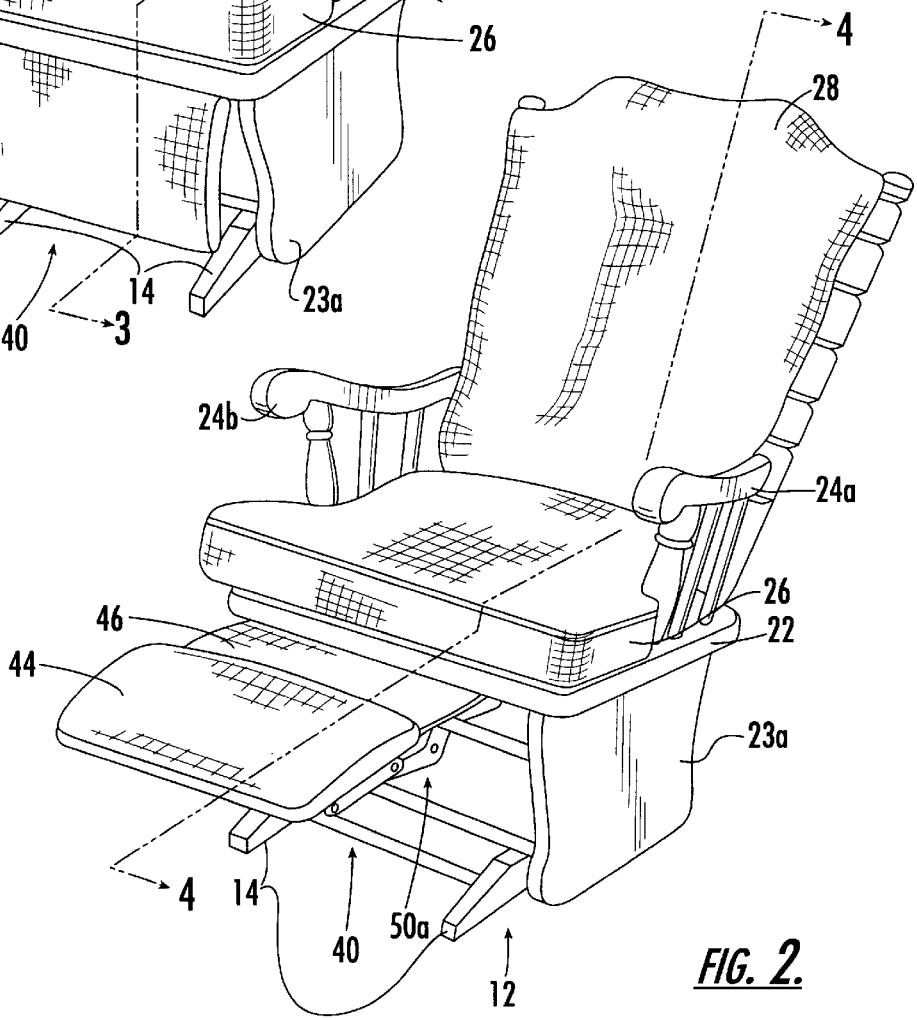
FIG. 2 is a perspective view of the chair of FIG. 1 with the ottoman in its extended position.

Referring now to the drawings, FIGS. 1 and 2 show a gliding recliner chair, designated broadly at 10. The chair 10 includes a stationary base 12, a seat 21, a pair of armrests 24*a*, 24*b*, a backrest 28, and an ottoman 40. The base 12 (FIGS. 1 through 4) comprises legs 14, a central tower 16 that extends upwardly from the legs 14, a pair of forward arms 18 that extend forwardly from the tower 16 (only one forward arm 18 is shown herein), and a pair of rear arms 20 that extend rearwardly from the tower 16 (only one rear arm 20 is illustrated herein). The seat 21, which is positioned generally above the base 12, includes a wooden seat panel 22 upon which rests a seat cushion 26. Each of a pair of side panels 23*a*, 23*b* is fixed to the lower surface of a respective lateral portion of the seat panel 22. The side panels 23*a*, 23*b* may be solid as illustrated, or may include openings or apertures, such as would be present in a "cage" structure having decorative bars or spindles positioned in a frame. The armrests 24*a*, 24*b* are fixed to and extend upwardly from lateral portions of the seat panel 22. The backrest 28 extends generally upwardly and slightly rearwardly from the rear portion of the seat panel 22 and the armrests 24*a*, 24*b*. A handle 25 is positioned adjacent to and laterally from the side panel 23*a*.

Figure 5:
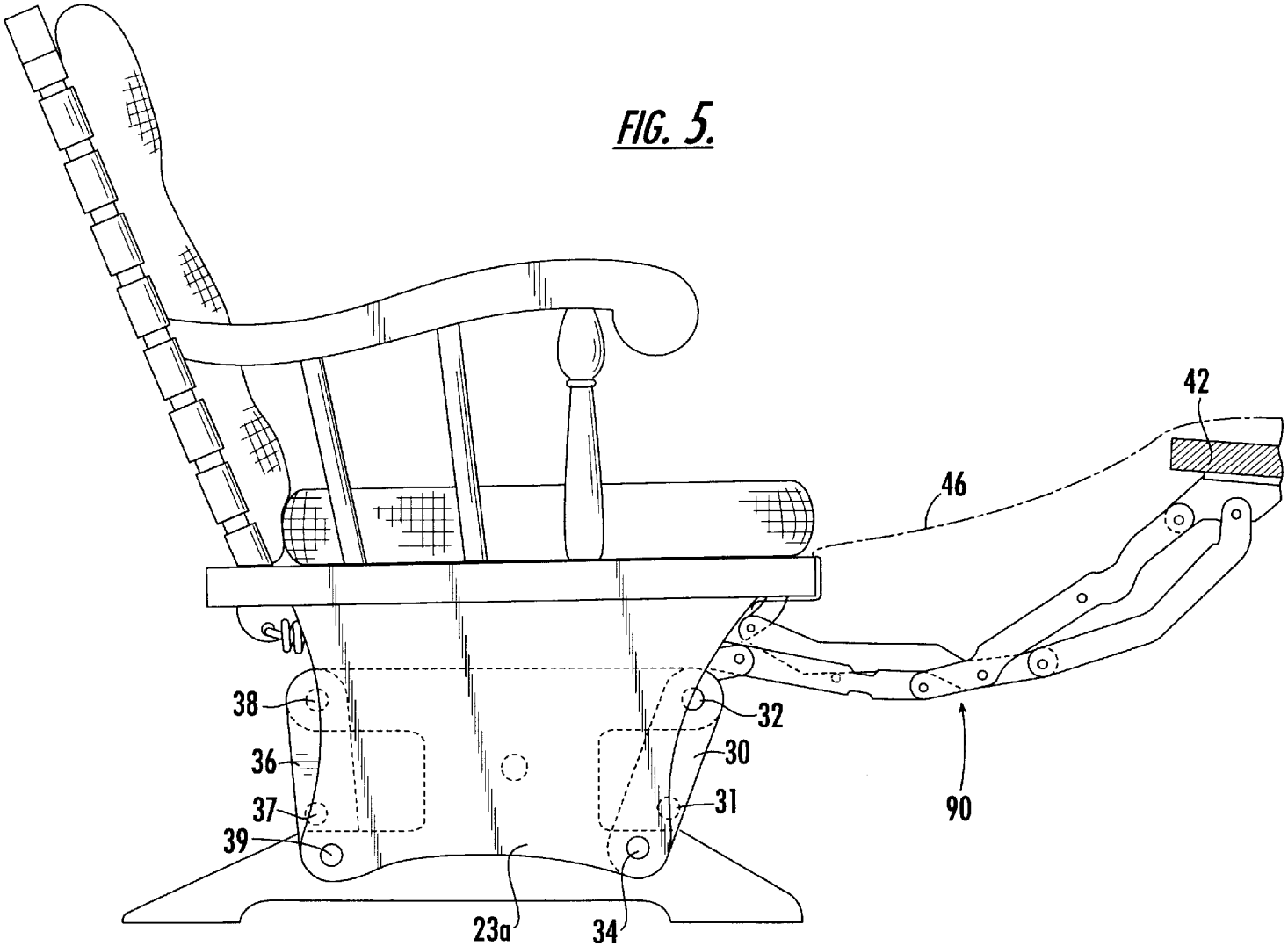
FIG. 5 is a side view of the chair of FIG. 1 with the ottoman in its extended position and the glide links illustrated.
Figure 6:
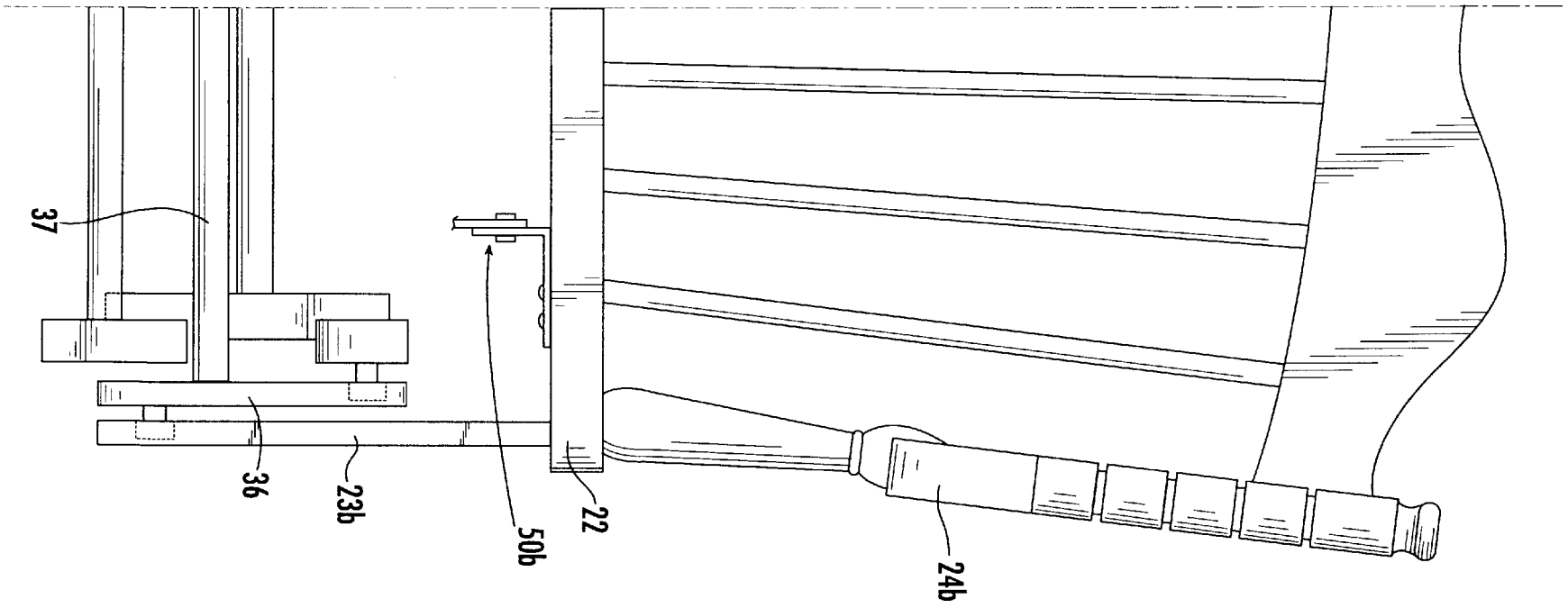
FIG. 6 is a partial end view of the chair of FIG. 1.

Each of the side panels 23*a*, 23*b* is interconnected with the base 12 through a respective pair of glide links 30, 36 (FIGS. 5 and 6); because they are mirror images of each other, only one of each pair of the glide links 30, 36 will be described below. The front glide link 30 is attached to the forward end of the forward arm 18 at a pivot 32 and is also attached to the lower front portion of the side panel 23*a* at a pivot 34. A front stabilizer bar 31 is fixed to and extends transversely between central portions of the front glide links 30 beneath the base forward arms 18. Each rear glide link 36 is pivotally interconnected with a rear arm 20 at a pivot 38 and is also attached to the lower rear portion of the side panel 23*a* at a pivot 39. A rear stabilizer bar 37 extends transversely between central portions of the rear glide links 36 beneath the base rear arms 20. In this configuration, the seat 21, the side panels 23*a*, 23*b*, and the ottoman 40 are free to glide forwardly and rearwardly relative to the base 12 in a double pendulum motion.

The ottoman 40 (FIG. 2) includes a ottoman panel 42 covered by an ottoman cushion 44 and a fabric connecting sheet 46. The connecting sheet 46 is attached to the front portion of the seat 21 and to the upper end of the ottoman cushion 44. When the ottoman 40 is extended, the connecting sheet 46 covers the space between the seat 21 and ottoman cushion 44 that would otherwise be uncovered.

The movement of the ottoman 40 relative to the fixed unit comprising the seat 21, the side panels 23*a*, 23*b*, the armrests 24*a*, 24*b*, and the backrest 28 is controlled by a pair of mechanisms 50*a*, 50*b* (FIGS. 3, 4 and 7 through 9). The mechanisms 50*a*, 50*b* are mirror images of one another about a plane of symmetry that is perpendicular to the underlying surface and bisects the chair 10 between the armrests 24*a*, 24*b*. In the interest of clarity and brevity, only one mechanism 50*a* will be described herein; those skilled in this art will appreciate that this discussion is applicable to the mirror image mechanism 50*b* also.

The mechanism 50*a* (FIGS. 3, 4 and 7 through 9) comprises a seat bracket 52, a spring 58, an actuation linkage 60, and an ottoman linkage 90. These components are pivotally interconnected and configured to move the footrest ottoman cushion 44 from a retracted position, in which it is generally upright and positioned beneath the front end of the seat panel 22, to an extended position, in which the ottoman cushion 44 is generally horizontal and positioned forwardly of the seat panel 22.

Referring again to FIGS. 3 and 4, the seat bracket 52 is mounted to the lower surface of the seat panel 22 inboard from the side panel 23*a*. The seat bracket 52 includes a downwardly extending mounting panel 54 at its forward end and a downwardly extending mounting ear 56 at its rearward end. The mounting panel 54, which includes a drive axle aperture 55, provides a mounting location for other components of the mechanism 50*a*. The mounting ear 56 includes a spring aperture 57 for the mounting of the rearward end of the spring 58.

Figure 7:
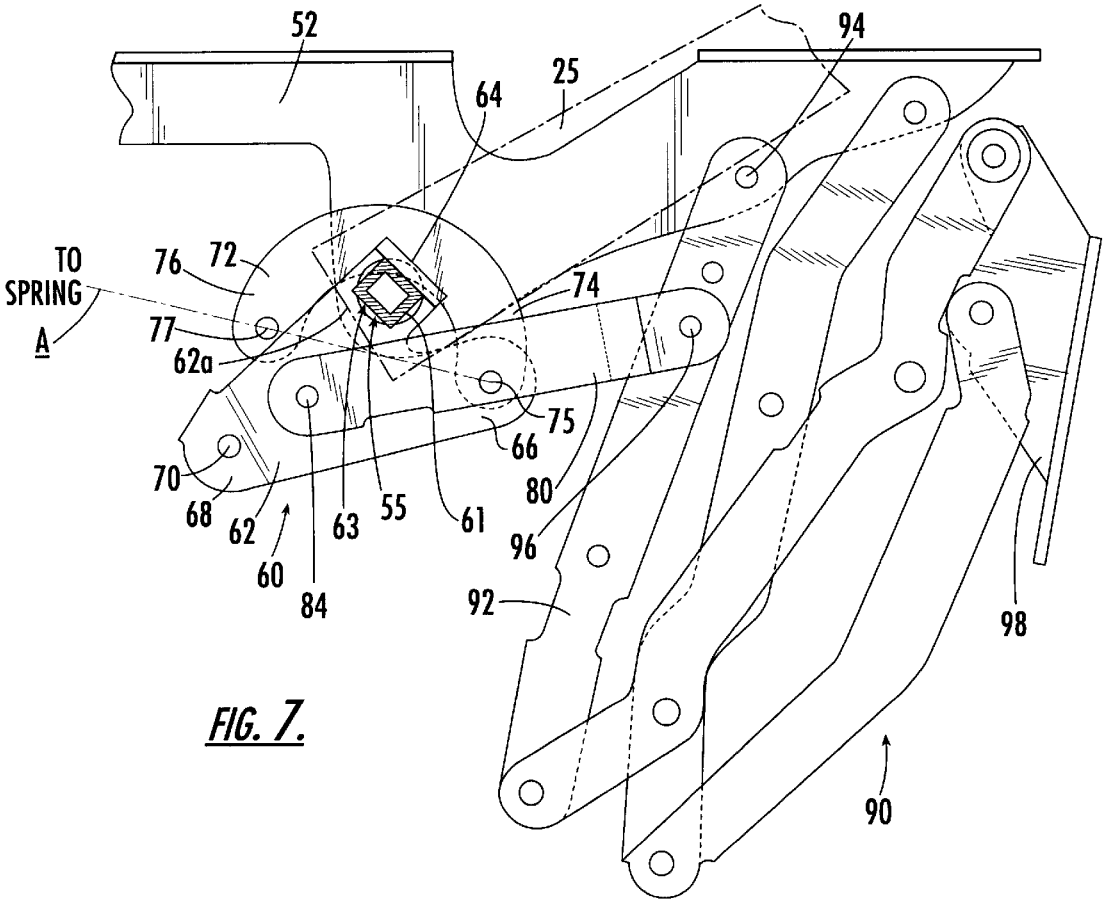
FIG. 7 is a greatly enlarged view of the actuation mechanism of the chair of FIG. 1 shown with the ottoman in its retracted position.
Figure 8:
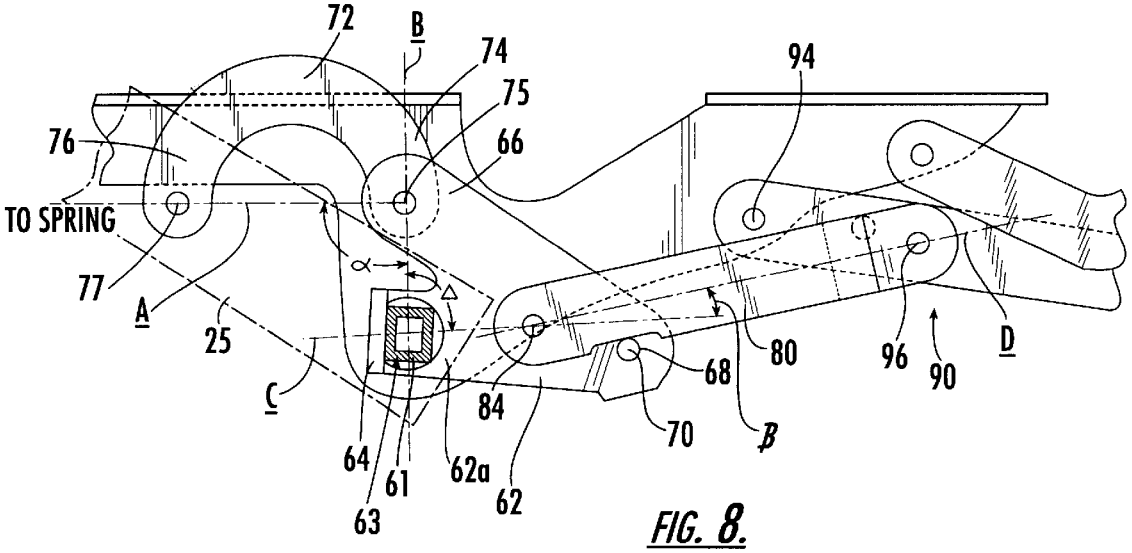
FIG. 8 is a greatly enlarged view of the actuation mechanism of the chair of FIG. 1 shown with the ottoman in its extended position.
Figure 9:
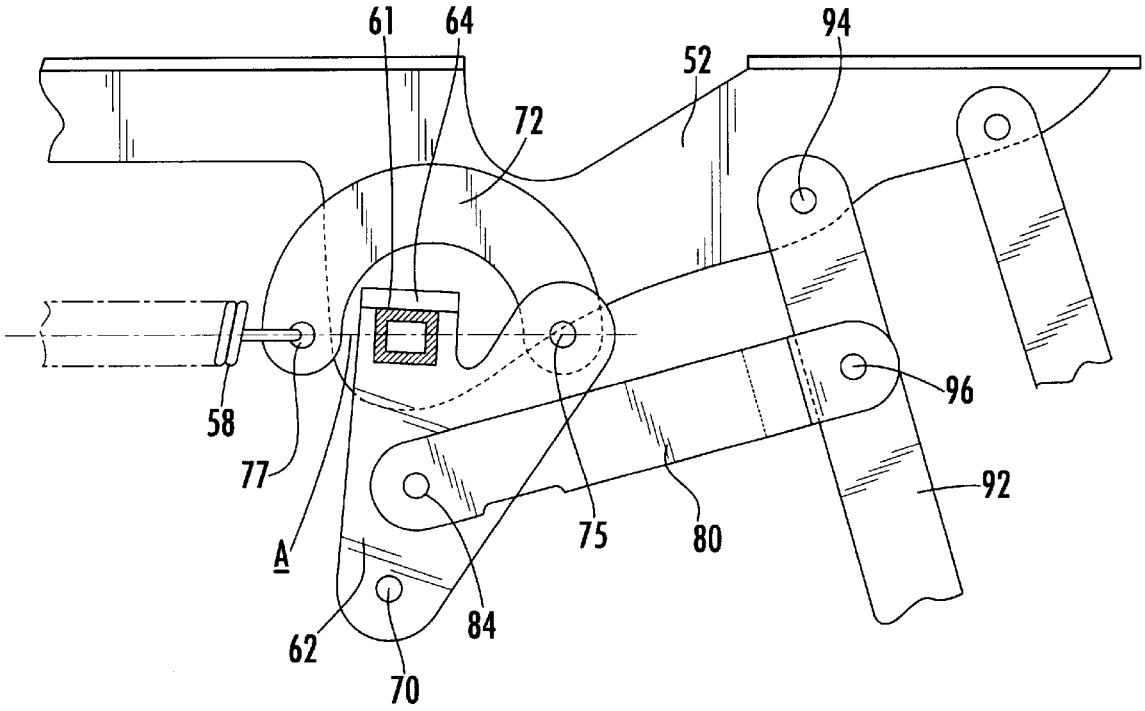
FIG. 9 is a greatly enlarged view of the actuation mechanism of the chair of FIG. 1 shown in an intermediate position.

Referring now to FIGS. 7 through 9, the actuation linkage 60 includes a drive axle 61, a bell crank 62, a spring tab 72, and an ottoman drive link 80. The drive axle 61 is an elongate tube of square cross-section that extends transversely between the mechanisms 50*a*, 50*b* and through their respective drive axle apertures 55. On one end, the drive axle 61 is attached to the handle 25. The bell crank 62 includes a body portion 62*a* having an aperture 63 through which the drive axle 61 extends. A laterally extending mounting tab 64 extends from the body portion 62*a* and rests flush against and is mounted to one face of the drive axle 61. The bell crank 62 also includes a front finger 66 and a rear finger 68 extending in generally opposite directions from the body portion 62*a*. The rear finger 68 includes a laterally-extending stop pin 70.

Still referring to FIGS. 7 through 9, the spring tab 72 is generally semi-annular in shape. It includes a front end portion 74 that is pivotally interconnected with the front finger 66 of the bell crank 62 at a pivot 75. The rear end portion 76 of the spring tab 72 includes an aperture 77 through which it is mounted the front end of the spring 58, with the result that the spring 58 extends generally horizontally between the spring tab rear end portion 76 and the seat bracket mounting ear 56.

Referring again to FIGS. 7 through 9, the ottoman drive link 80 is a generally straight link. At its rear end portion, the ottoman drive link 80 is pivotally interconnected with the rear finger 68 of the bell crank 62 at a pivot 84 nearer to the body portion 62*a* than is the stop pin 70. The front end portion of the ottoman drive link 80 is then pivotally interconnected with the footrest linkage 90.

Figure 3:
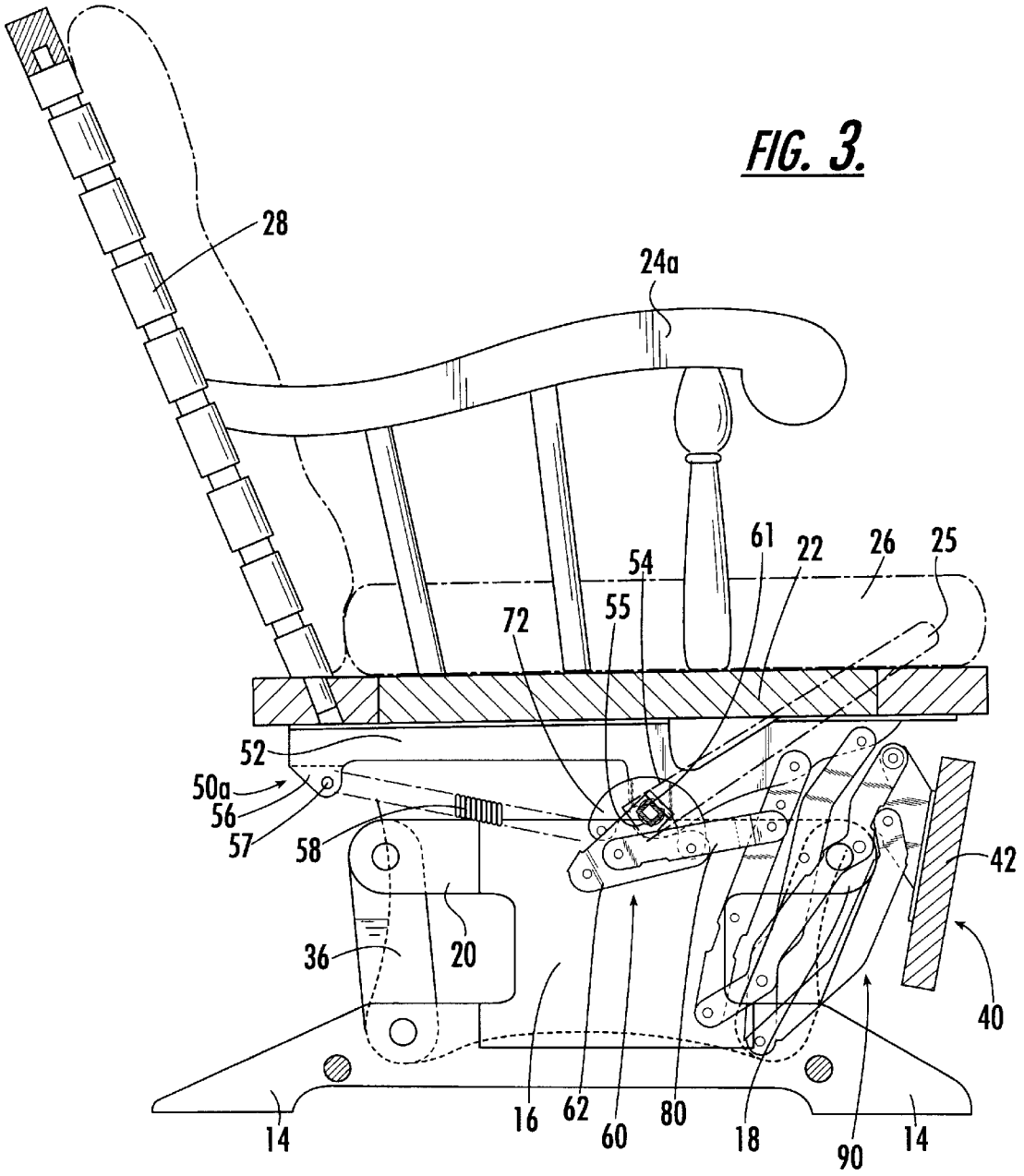
FIG. 3 is an enlarged side section view of the chair of FIG. 1.
Figure 4:
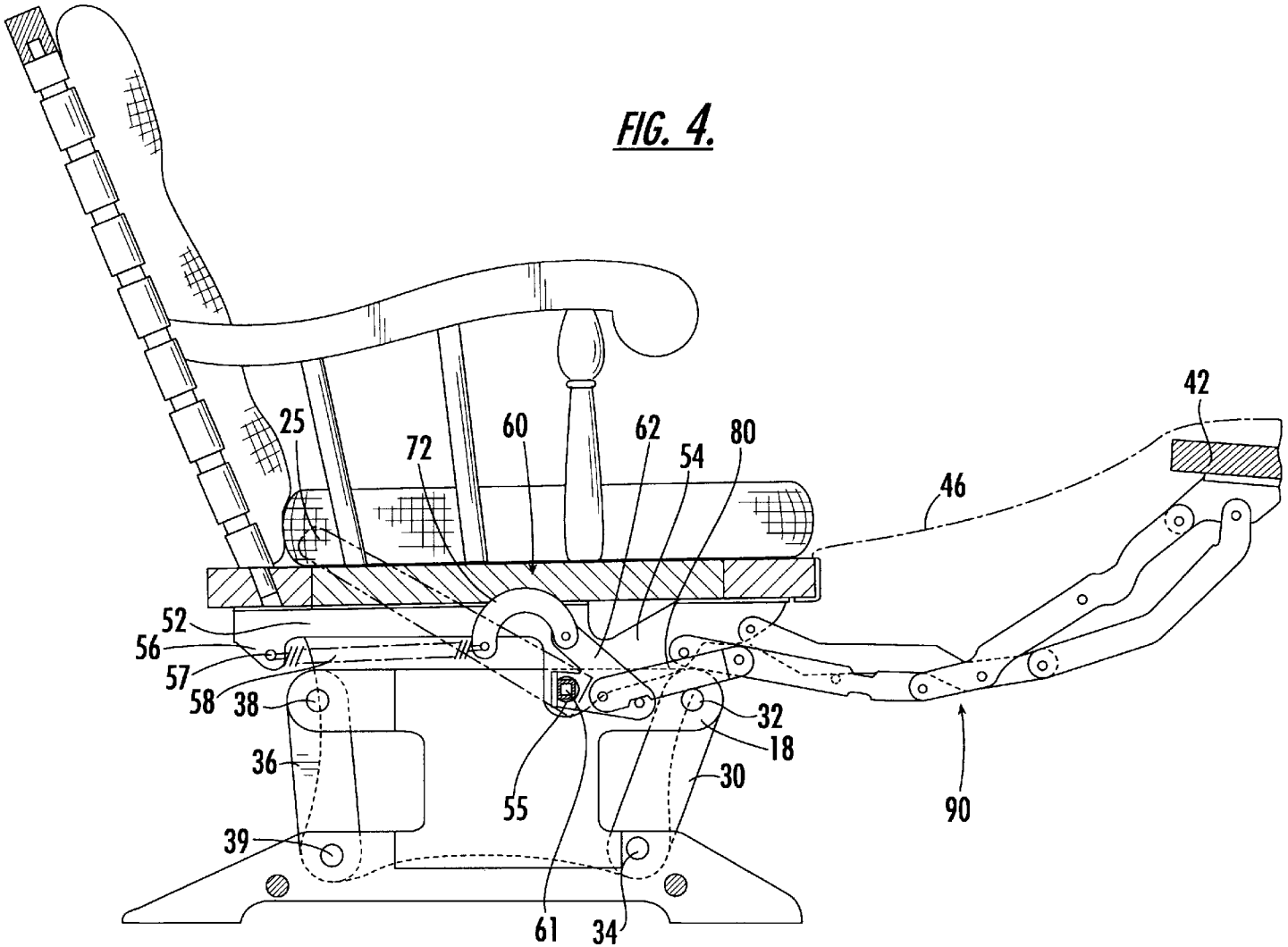
FIG. 4 is a side section view of the chair of FIG. 1 with the ottoman in its extended position.

As illustrated in FIGS. 3 and 4, the ottoman linkage 90 is a typical pantographic linkage known to those skilled in this art to be suitable for use in extending and retracting an ottoman. The ottoman linkage 90 includes a rear ottoman link 92 that is pivotally interconnected at a pivot 94 with the mounting panel 54 of the seat bracket 52. At an intermediate point, the front end portion of the ottoman drive link 80 is pivotally interconnected with the rear ottoman link 92 at a pivot 96. This pivotal interconnection couples the actuation linkage 60 with the footrest linkage 90. At the opposite end of the ottoman linkage 90, a mounting bracket 98 is fixed to the ottoman panel 42. Those skilled in this art will appreciate that other pantographic linkages known to be suitable for extending an ottoman can also be used with the present invention.

Operation of the chair 10 is best understood by reference to FIGS. 3, 4 and 7 through 9, which show the chair 10 with the ottoman 40 in its retracted and extended positions. The chair 10 begins with the ottoman 40 in its retracted position, in which the ottoman panel 42 is generally upright and positioned beneath a front portion of the seat panel 22. When the ottoman 40 is in its retracted position, the links of the mechanism 50a take the position illustrated in FIGS. 3 and 7. In the retracted position, the handle 25 points forwardly and upwardly from its interconnection with the drive axle 61. The bell crank 62 is oriented such that its front finger 66 points generally forwardly and its rear finger 68 points generally rearwardly. The spring tab 72 is positioned such that its front end portion 74 is located forwardly of the drive axle 61, its rear end portion 76 is located rearwardly of the drive axle 61, and its intermediate portion 75*a* passes above the drive axle 61. The spring 58 extends from the mounting bar 56 to the spring tab rear end portion 76. The rear end portion of the drive ottoman link 80 extends below the drive axle 61, and the front end portion of the ottoman drive link 80 slopes upwardly as it moves from rear to front such that its pivot 96 with the rear ottoman link 92 is positioned approximately level with the drive axle 61. The entire ottoman linkage 90 is collapsed with the rear ottoman link 92 extending downwardly and slightly rearwardly from the pivot 94. The collapsed ottoman linkage positions the mounting bracket 98, and consequently the ottoman panel 42, upright and beneath the front portion of the seat panel 22.

It can be seen that in FIG. 7, in this configuration, the spring 58 biases the actuation linkage 60 toward the retracted position. The spring 58 is sized so that it remains in tension throughout the movement of the mechanism 50*a*. This tension tends to draw the rear end portion 76 of the spring tab 72 in a rearward direction. As a result, the front end portion 74 of the spring tab 72 is also drawn rearwardly. This action biases the bell crank 62 in a clockwise direction (from the view of FIG. 7), which tends to draw the ottoman drive link 80, and in turn the footrest linkage 90, in a rearward direction. As a result, when the ottoman 40 is in the retracted position, the spring 58 and actuation linkage 60 biases the ottoman to remain in the retracted position.

Also, it is noteworthy that, when the ottoman is in the retracted position, the links of the actuation linkage 60 that translate as well as rotate as the ottoman 40 is extended (namely, the spring tab 72 and the ottoman drive link 80) are arranged such that they form a "pocket" that encloses the drive axle 61. This arrangement enables these links to occupy only a very small space around the drive axle 61, thereby freeing up space in this area for other components as desired.

The ottoman 40 is actuated by pulling the handle 25 such that it moves rearwardly (counterclockwise as viewed in FIG. 7). This action causes the drive axle 61 to rotate counterclockwise within the drive axle aperture 55. The rotation of the drive axle 61 drives the bell crank 62 counterclockwise. The rotation of the bell crank 62 drives the front end portion 74 of the spring tab 72 upwardly and, eventually, rearwardly; the rear end portion 76 of the spring tab 72 similarly moves upwardly and rearwardly as tension is maintained in the spring 58. The rotation of the bell crank 62 also forces the ottoman drive link 80 to a forward position. The action of the ottoman drive link 80 forces the rear ottoman link 92 to pivot relative to the seat bracket 52 about the pivot 94. This action drives the remainder of the ottoman linkage 90 to extend the ottoman panel 42 and to reorient it such that it is generally horizontally disposed. Extension of the ottoman 40 ceases when the ottoman drive link 80 contacts the stop pin 70 (FIGS. 4 and 8), at which point the handle 25 has rotated approximately 135 to 150 degrees.

Notably, when the ottoman is in the extended position, the actuation linkage 60 is biased toward the extended position (FIG. 8). Because the spring 58 remains in tension, it pulls the rear end portion 76 of the spring tab 72 rearwardly, which also pulls the front end portion 74 of the spring tab 72 rearwardly. This tension urges the bell crank 62 in a counterclockwise direction as viewed in FIG. 8. This biasing tends to continue to drive the ottoman drive link 80 forwardly, thereby maintaining the ottoman linkage 90 in an extended position. As a result, the ottoman 40 is secured in the extended position until the occupant exerts a sufficient downward force on the ottoman 40 to overcome the biasing force provided by the spring 58.

It is also noteworthy that, as the handle 25 is employed to drive the ottoman 40 from the retracted to the extended position, the ottoman linkage 90 extends the ottoman 40 forwardly only slightly until the actuation linkage 60 has moved to a position in which it can, in combination with the spring 58, assist in the extension of the ottoman linkage. This is best illustrated by reference to FIG. 9, in which the actuation linkage 60 is shown in an intermediate position. As shown in FIG. 9, in this intermediate position (about 25 to 30 degrees of rotation of the handle 25), the bell crank 62 has rotated counterclockwise to a sufficient extent that the thrust line A of the spring tab 72 (i.e., the imaginary line between the pivot 75 and the aperture 77 of the spring tab 72) and the colinear thrust line of the spring 58 are positioned just above the central axis of the drive axle 61. As such, the tension in the spring 58 tends to draw the spring tab 72 rearwardly, which in turn assists the rotation of the bell crank 62 in a counterclockwise direction (as viewed in FIG. 9) and the extension of the ottoman linkage 90. Thus, once the spring tab 72 has reached this position, further movement toward the extended position is assisted by the spring 58. Therefore, for much of its travel to the extended position (about 105 to 110 degrees), extension of the ottoman 40 is assisted by the spring 58. As a result, of the spring 58 assisting the ottoman 40 as it extends, the undesirable "pitching" feeling experienced by the occupant that can accompany the extension of the ottoman 40 is reduced. The occupant feels the support of the rising ottoman 40 (further supported by the spring 58) as he removes his feet from the floor.

Also, examination of FIG. 8 shows that the aforementioned thrust line of the spring 58 forms an angle $\alpha$ of preferably about 80 to 100 degrees, and more preferably about 90 degrees, with a first bell crank thrust line B that extends between the pivot 75 and the drive axle 61. In this configuration, the spring 58 has its greatest mechanical advantage relative to the remainder of the actuation linkage 60. At the same time, the actuation linkage 60 has, through the ottoman linkage 90, placed the ottoman panel 42 in an extended (but unlocked) position that desirably supports the feet and legs of most occupants without retracting, yet enables the ottoman 40 to be retracted with relatively little effort. Important to this is the angular relationship of a second bell crank thrust line C that extends between the drive axle 61 and the pivot 84 and an ottoman drive link thrust line D that extends between the pivots 84 and 96. The angle $\beta$ between these thrust lines should be between about 10 and 18 degrees. This angular relationship enables the spring 58 to provide sufficient support to the ottoman panel 42 through the actuation and ottoman linkages 60, 90 that the ottoman 40 can remain in the extended position as desired under the weight of typical occupants, yet the ottoman 40 can be retracted with relatively little effort from the occupant and without manual manipulation of the handle 25. Also, it is preferred for space consideration S that the angular relationship $\Delta$ between the first and second bell crank thrust lines B, C be between about 70 and 100 degrees.

Those skilled in this art will appreciate that other configurations of the actuation and ottoman linkages 60, 90 may also include the aforementioned angular relationships for $\alpha$ and $\beta$. For example, the spring 58 may be attached to the front end of the seat bracket 52 (or directly to the seat), and the spring tab 72 may then be oriented such that its front and rear end portions 74, 76 extend upwardly in the retracted and extended positions. In this configuration, the spring tab 72 can still form a "pocket" within which the drive axle 61 resides when in the retracted position. In the extended position, the spring tab 72 would be positioned such that its front end portion 74 is located forwardly of the drive axle 61. However, the angular relationship $\alpha$ between the thrust line of the spring 58 and the first bell crank thrust line would still be between about 80 and 100 degrees, and the angular relationship $\beta$ between the second thrust line and the ottoman drive link thrust line would still be between about 10 and 18 degrees. Thus, the preferred angular relationships and the performance advantages they convey can be preserved.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein. In the claims, means-plus-function clauses are intended to cover the structures described herein as performing the recited function and not only structural equivalents but also equivalent structures.

What is claimed is:

1. A gliding seating unit, comprising:

a base configured to rest upon an underlying surface;

a seat assembly positioned above said base, said seat assembly including a generally horizontal seat and a pair of side panels connected with and extending downwardly from opposite side edges of said seat;

an extendable ottoman including an ottoman panel;

a gliding assembly attached between said base and said seat assembly for enabling and controlling gliding movement of said seat relative to said base; and an ottoman-extending mechanism attached to said seat and a footrest, said mechanism including a seat bracket attached to said seat, an ottoman linkage attached to said ottoman and, and an actuation linkage pivotally interconnected with said seat bracket and said ottoman linkage;

wherein said ottoman linkage is configured to move said ottoman between a retracted position, in which said ottoman panel is generally upright and located below said seat, and an extended position, in which said ottoman panel is generally horizontally disposed and located forward of said seat;

and wherein said actuation linkage comprises a rotatable, transversely-extending drive axle that passes through said seat bracket, a bell crank attached to said drive axle, a spring tab pivotally interconnected with said bell crank, and an ottoman drive link pivotally interconnected with said bell crank and said ottoman linkage, said actuation linkage being configured such that rotation of said drive axle drives said ottoman between its retracted and extended positions.

2. The gliding seating unit defined in claim 1, wherein said gliding assembly comprises front and rear swing links, each of which is attached at an upper end thereof to said base and at a lower end thereof to one of said side panels.

3. The gliding seating unit defined in claim 2, wherein said lower ends of said front and rear swing links are closer to one another than said upper ends of said front and rear swing links.

4. The gliding seating unit defined in claim 1, further comprising a generally upright backrest fixed to a rear portion of said seat.

5. The gliding seating unit defined in claim 1, wherein said side panels are fixed to said seat.

6. The gliding seating unit defined in claim 1, wherein said ottoman linkage is a pantographic linkage.

7. The gliding seating unit defined in claim 1, wherein said spring tab has a generally semi-annular shape, and when said ottoman is in its retracted position, an intermediate portion of said spring tab is located above said drive axle, and opposing ends of said spring tab are positioned below and on opposite sides of said drive axle.

8. The gliding seating unit defined in claim 1, wherein a portion of said ottoman drive link is located beneath said drive axle when said ottoman is in its retracted position.

9. The gliding seating unit defined in claim 1, further comprising a spring extending between said seat or said seat bracket and said spring tab.

10. The gliding seating unit defined in claim 1, wherein said spring tab and said ottoman drive link form a pocket around said drive axle when said ottoman is in its retracted position.

11. The gliding seating unit defined in claim 1, wherein said bell crank is directly pivotally interconnected with said ottoman drive link, and said ottoman drive link is directly pivotally interconnected with a rear ottoman link.

12. A gliding seating unit, comprising:

a base configured to rest upon an underlying surface;

a seat assembly positioned above said base, said seat assembly including a generally horizontal seat and a pair of side panels connected with and extending downwardly from opposite side edges of said seat;

an extendable ottoman including an ottoman panel;

a gliding assembly attached between said base and said seat assembly for enabling and controlling gliding movement of said seat relative to said base; and an ottoman-extending mechanism attached to said seat and said ottoman, said mechanism including a seat bracket attached to said seat, an ottoman linkage attached to a footrest and, an actuation linkage pivotally interconnected with said seat bracket and said ottoman linkage, and a spring attached to one of said seat or said seat bracket;

wherein said ottoman linkage is configured to move said ottoman between a retracted position, in which said ottoman panel is generally upright and located below said seat, and an extended position, in which said ottoman panel is generally horizontally disposed and located forward of said seat;

wherein said actuation linkage comprises a rotatable, transversely-extending drive axle that passes through said seat bracket, a bell crank attached to said drive axle, a spring connected with said seat bracket, a spring tab directly pivotally interconnected with said bell crank and attached to said spring, and an ottoman drive link directly pivotally interconnected with said bell crank and said ottoman linkage, said actuation linkage being configured such that rotation of said drive axle drives said ottoman between its retracted and extended positions;

and wherein tension in said spring biases said bell crank in a first rotative direction when said ottoman is in the retracted position so that said ottoman is urged to remain in the retracted position, and wherein tension in said spring biases said bell crank in a second rotative direction opposite said first direction so that said ottoman is urged to remain in the extended position.

13. The gliding seating unit defined in claim 12, wherein said gliding assembly comprises front and rear swing links, each of which is attached at an upper end thereof to said base and at a lower end thereof to one of said side panels.

14. The gliding seating unit defined in claim 12, wherein said spring biases said bell crank toward the second rotative direction after between about 20 and 30 degrees of travel from the retracted position toward the extended position.

15. The gliding seating unit defined in claim 12, wherein said side panels are fixed to said seat.

16. The gliding seating unit defined in claim 12, wherein said ottoman linkage is a pantographic linkage.

17. The gliding seating unit defined in claim 12, wherein said spring tab has a generally semi-annular shape, and when said ottoman is in its retracted position, an intermediate portion of said spring tab is located above said drive axle, and opposing ends of said spring tab are positioned below and on opposite sides of said drive axle.

18. The gliding seating unit defined in claim 17, wherein a portion of said ottoman drive link is located beneath said drive axle when said ottoman is in its retracted position.

19. The gliding seating unit defined in claim 12, wherein said spring tab and said ottoman drive link overlap at respective opposite end portions to form a pocket therebetween, and wherein said drive axle is positioned in said pocket when said ottoman is in its retracted position.

20. A gliding seating unit, comprising:

a base configured to rest upon an underlying surface;

a seat assembly positioned above said base, said seat assembly including a generally horizontal seat and a pair of side panels connected with and extending downwardly from opposite side edges of said seat;

an extendable ottoman including an ottoman panel;

a gliding assembly attached between said base and said seat assembly for enabling and controlling gliding movement of said seat relative to said base; and an ottoman-extending mechanism attached to said seat and said ottoman, said mechanism including a seat bracket attached to said seat, an ottoman linkage attached to a footrest and, an actuation linkage pivotally interconnected with said seat bracket and said ottoman linkage, and a spring attached to one of said seat or said seat bracket;

wherein said ottoman linkage is configured to move said ottoman between a retracted position, in which said ottoman panel is generally upright and located below said seat, and an extended position, in which said ottoman panel is generally horizontally disposed and located forward of said seat, wherein said actuation linkage comprises a rotatable, transversely-extending drive axle that passes through said seat bracket, a bell crank attached to said drive axle, a spring tab pivotally interconnected with said bell crank and attached to said spring, and an ottoman drive link pivotally interconnected with said bell crank and said ottoman linkage, said actuation linkage being configured such that rotation of said drive axle drives said ottoman between its retracted and extended positions;

wherein a spring thrust line is defined between opposite ends of said spring, and a first bell crank thrust line is defined between said drive axle and a pivot between said spring tab and said bell crank;

wherein an ottoman drive link thrust line is defined between a pivot interconnecting said ottoman drive link and said bell crank and a pivot interconnecting said ottoman drive link and said ottoman linkage, and a second bell crank thrust line is defined between said drive axle and a pivot between said bell crank and said ottoman drive link;

and wherein in the extended position, an angle between said spring thrust line and said first bell crank thrust line is between about 80 and 100 degrees, and an angle between said ottoman drive link thrust line and said second bell crank thrust line is between about 10 and 18 degrees.

21. The gliding seating unit defined in claim 20, wherein said gliding assembly comprises front and rear swing links, each of which is attached at an upper end thereof to said base and at a lower end thereof to one of said side panels.

22. The gliding seating unit defined in claim 20, wherein said spring tab is directly pivotally interconnected with said bell crank, and said ottoman drive link is directly pivotally interconnected with said bell crank and said ottoman linkage.

23. The gliding seating unit defined in claim 20, wherein said side panels are fixed to said seat.

24. The gliding seating unit defined in claim 20, wherein said ottoman linkage is a pantographic linkage.

25. The gliding seating unit defined in claim 20, wherein said spring tab has a generally semi-annular shape, and when said ottoman is in its retracted position, an intermediate portion of said spring tab is located above said drive axle, and said spring tab thrust line is positioned below said drive axle.

26. The gliding seating unit defined in claim 25, wherein a portion of said ottoman drive link is located beneath said drive axle when said ottoman is in its retracted position.

27. The gliding seating unit defined in claim 20, wherein said spring tab and said ottoman drive link overlap at respective opposite end portions to form a pocket therebetween, and wherein said drive axle is positioned in said pocket when said ottoman is in its retracted position.

28. The gliding seating unit defined in claim 20, wherein an angle between said first and second bell crank thrust lines is between about 70 and 100 degrees.

29. A gliding seating unit, comprising:

a base configured to rest upon an underlying surface;

a seat assembly positioned above said base, said seat assembly including a generally horizontal seat and a pair of side panels connected with and extending downwardly from opposite side edges of said seat;

an extendable ottoman including an ottoman panel;

a gliding assembly attached between said base and said seat assembly for enabling and controlling gliding movement of said seat relative to said base; and an ottoman-extending mechanism attached to said seat and a footrest, said mechanism including a seat bracket attached to said seat, an ottoman linkage attached to said ottoman and, and an actuation linkage pivotally interconnected with said seat bracket and said ottoman linkage;

wherein said ottoman linkage is configured to move said ottoman between a retracted position, in which said ottoman panel is generally upright and located below said seat, and an extended position, in which said ottoman panel is generally horizontally disposed and located forward of said seat;

wherein said actuation linkage comprises a rotatable, transversely-extending drive axle that passes through said seat bracket, a bell crank attached to said drive axle, a spring tab pivotally interconnected with said bell crank, and an ottoman drive link pivotally interconnected with said bell crank and said ottoman linkage, said actuation linkage being configured such that rotation of said drive axle drives said ottoman between its retracted and extended positions;

and wherein said spring tab and said ottoman drive link form a pocket around said drive axle when said ottoman is in its retracted position.

* * * * *

UNITED STATES PATENT AND TRADEMARK OFFICE

CERTIFICATE OF CORRECTION

PATENT NO. : 6,059,367

DATED : May 9, 2000

INVENTOR(S) : W. Clark Rodgers

It is certified that error appears in the above-indentified patent and that said Letters Patent is hereby corrected as shown below:

On the title page,

Under paragraph entitled "References Cited" please add prior omitted from October 5, 1998 IDS.

--144,603 11/1873 Enger 297/329--
--195,395 09/1877 Pope 297/75--
--2,142,714 1/3/39 Campbell 297/329x--
--2,869,619-- 1/20/59 Petersen et al; 297/75x--
--3,054,639-- 9/62 Schliephacke 297/89--
--3,096,118-- 7/63 Dubeck 297/75--
--3,243,225 3/29/66 Katz 297/75--
--3,730,585 5/1/73 Rogers, Jr. et al; 297/85--
--3,815,954 6/11/74 Rogers, Jr. et al; 297/271
--4,291,913 9/29/81 Kowalski 297/89--
--4,437,701 3/20/84 Mizelle 297/85--

UNITED STATES PATENT AND TRADEMARK OFFICE

CERTIFICATE OF CORRECTION

PATENT NO. : 6,059,367

DATED : May 9, 2000

INVENTOR(S) : W. Clark Rogers

It is certified that error appears in the above-indentified patent and that said Letters Patent is hereby corrected as shown below:

--4,536,029 8/20/85 Rogers, Jr. 297/281--
--4,544,201 10/1/85 Rogers, Jr. 297/271--
--4,601,513 7/22/86 Pine 297/270--
--4,700,920 10/20/87 Horn 248/370--
--5,129,701 7/14/92 Pine 297/68--
--5,344,214 9/6/94 Trent 297/270--
--5,427,433 7/27/95 Holobaugh, Jr., 297/273--
--818,343 6/37 France 297/329--
--3,524,056 1/8/87 Germany 297/68--

Signed and Sealed this

Twentieth Day of March, 2001

Nicholas P. Godici

*Attest:*

NICHOLAS P. GODICI

*Attesting Officer*

*Acting Director of the United States Patent and Trademark Office*